US009506631B2

(12) United States Patent
Erhard et al.

(10) Patent No.: US 9,506,631 B2
(45) Date of Patent: Nov. 29, 2016

(54) PROFILE RAIL, CONNECTING ELEMENT, ILLUMINATING MODULE, LIGHTING SYSTEM AND LIGHT BOX

(75) Inventors: Philipp Erhard, Mering (DE); Eckhard Frank, Munich (DE); Helmut Neuhasuer, Geisenfeld (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/879,281

(22) PCT Filed: Oct. 10, 2011

(86) PCT No.: PCT/EP2011/067633

§ 371 (c)(1),
(2), (4) Date: Apr. 12, 2013

(87) PCT Pub. No.: WO2012/049115

PCT Pub. Date: Apr. 19, 2012

(65) Prior Publication Data

US 2013/0208476 A1 Aug. 15, 2013

(30) Foreign Application Priority Data

Oct. 13, 2010 (DE) ..... 10 2010 042 377

(51) Int. Cl.
*F21V 17/18* (2006.01)
*F21V 17/16* (2006.01)
*F21V 21/088* (2006.01)

(52) U.S. Cl.
CPC ..... *F21V 17/18* (2013.01); *F21S 4/20* (2016.01); *F21V 17/16* (2013.01); *F21V 21/088* (2013.01)

(58) Field of Classification Search
CPC ..... F21V 17/16; F21V 17/18; F21V 21/088; F21S 4/003
See application file for complete search history.

(56) References Cited

U.S. PATENT DOCUMENTS

| | | | | |
|---|---|---|---|---|
| 4,471,415 | A * | 9/1984 | Larson et al. | 362/249.14 |
| 4,845,601 | A * | 7/1989 | Podbury et al. | 362/125 |
| 4,999,755 | A * | 3/1991 | Lin | 362/217.02 |
| 5,031,083 | A * | 7/1991 | Claesson | 362/249.06 |
| 5,365,411 | A * | 11/1994 | Rycroft et al. | 362/20 |
| 5,433,024 | A * | 7/1995 | Lerner | 40/546 |
| 5,587,608 | A * | 12/1996 | Meng | 257/712 |
| 6,033,088 | A | 3/2000 | Contigiani | |
| 6,050,703 | A | 4/2000 | Herbert | |
| 6,305,109 | B1 * | 10/2001 | Lee | 40/546 |
| 6,472,823 | B2 * | 10/2002 | Yen | 315/112 |
| 6,476,883 | B1 * | 11/2002 | Salimes et al. | 349/58 |
| 6,561,690 | B2 * | 5/2003 | Balestriero et al. | 362/555 |

(Continued)

FOREIGN PATENT DOCUMENTS

| | | |
|---|---|---|
| CN | 2828563 | 10/2006 |
| CN | 201421043 | 3/2010 |

OTHER PUBLICATIONS

Office Action (and an English translation thereof) dated Jun. 3, 2015 which issued in the corresponding Chinese Patent Application No. 201180049828.0.

*Primary Examiner* — Anne Hines
(74) *Attorney, Agent, or Firm* — Cozen O'Connor

(57) ABSTRACT

A DIN rail with at least one bottom wall (2) and two side walls (3*a*, 3*b*) emerging from the bottom wall (2) on opposite sides, wherein the DIN rail (1) is designed to accommodate, in a form-fitting and/or force-fitting manner, at least one light-emitting module (7) in an accommodating area (4) delimited by the bottom wall (2) and the side walls (3*a*, 3*b*).

16 Claims, 7 Drawing Sheets

(56) References Cited

U.S. PATENT DOCUMENTS

| | | | | |
|---|---|---|---|---|
| 6,590,773 | B1 * | 7/2003 | Lin | 361/704 |
| 7,170,751 | B2 * | 1/2007 | Mayer | 361/719 |
| 7,267,461 | B2 * | 9/2007 | Kan et al. | 362/373 |
| 7,394,658 | B2 * | 7/2008 | McPhee | 361/710 |
| 7,405,715 | B2 * | 7/2008 | Guzman et al. | 345/83 |
| 7,470,055 | B2 * | 12/2008 | Hacker et al. | 362/640 |
| 7,954,979 | B2 * | 6/2011 | Sommers et al. | 362/217.01 |
| 8,092,038 | B2 * | 1/2012 | Liao et al. | 362/217.1 |
| 8,454,193 | B2 * | 6/2013 | Simon et al. | 362/217.17 |
| 2002/0125839 | A1 * | 9/2002 | Yen | 315/291 |
| 2005/0040772 | A1 * | 2/2005 | Guzman et al. | 315/291 |
| 2006/0146531 | A1 * | 7/2006 | Reo et al. | 362/244 |
| 2007/0047207 | A1 * | 3/2007 | McPhee | 361/704 |
| 2008/0106892 | A1 * | 5/2008 | Griffiths et al. | 362/223 |
| 2008/0155915 | A1 * | 7/2008 | Howe et al. | 52/220.3 |
| 2008/0219002 | A1 * | 9/2008 | Sommers et al. | 362/247 |
| 2008/0298058 | A1 * | 12/2008 | Kan et al. | 362/240 |
| 2009/0073693 | A1 * | 3/2009 | Nall et al. | 362/249.02 |
| 2009/0323334 | A1 * | 12/2009 | Roberts et al. | 362/247 |
| 2010/0214770 | A1 | 8/2010 | Anderson | |
| 2010/0226125 | A1 * | 9/2010 | Liao et al. | 362/235 |
| 2011/0058358 | A1 * | 3/2011 | Soo et al. | 362/147 |
| 2011/0163341 | A1 * | 7/2011 | Van Elmpt et al. | 257/98 |

* cited by examiner

PROFILE RAIL, CONNECTING ELEMENT, ILLUMINATING MODULE, LIGHTING SYSTEM AND LIGHT BOX

RELATED APPLICATIONS

This is a U.S. national stage of application No. PCT/EP2011/067633 filed on Oct. 10, 2011.

This patent application claims the priority of European application no. 10 2010 042 377.7 filed Oct. 13, 2010, the disclosure content of which is hereby incorporated by reference.

FIELD OF THE INVENTION

The invention relates to a DIN rail with at least one bottom wall and two side walls emerging from the bottom wall on opposite sides, wherein the walls form a U-shaped profile. The invention also relates to a connecting element for connecting two DIN rails. The invention also relates to a light-emitting module with at least one semiconductor light source. In addition, the invention relates to a light-emitting system. Furthermore, the invention relates to a light box with a light-emitting system.

BACKGROUND OF THE INVENTION

Until now, light boxes, i.e. illumination apparatuses which are usually closed on all sides and are provided for emitting flat light, for example for backlighting information signs or advertisement panels, have usually been illuminated with neon and fluorescent lamps as light sources. There are different types of illumination for light boxes, comprising backlighting on one side, backlighting on two sides or lateral illumination (for example from the left and/or right and/or bottom and/or top) by laterally injecting light into the air space in the light boxes. The lateral illumination can include in particular illumination from one to four sides. For mounting purposes, these lamps are spanned by the associated light box and can typically illuminate panes of glass, panes of acrylic glass and banners, which are combined on the front with a specially printed advertisement sheet. In order to mount the neon and fluorescent lamps, said lamps are fastened on frame outer walls using a lampholder system.

Alternatively, light can also be injected laterally into a light box. In this case, the light sources (sometimes with a reflector system) are fastened laterally in the frames of the light box. These light sources inject the light from the outside into the air space in the direction of a box center. The frames and rear walls of the poster boxes are usually painted matt white in order to distribute the light uniformly and homogeneously and to couple the light out forwards.

LED modules are also known as light sources, wherein the LED modules are fastened, for example screwed, individually to the frames or to a rear wall of the light box.

SUMMARY OF THE INVENTION

One object of the present invention is to provide an improved possible way of mounting semiconductor light sources, in particular in light boxes.

This and other objects are attained in accordance with one aspect of the invention directed to a DIN rail with at least one bottom wall and two side walls emerging from the bottom wall on opposite sides, wherein the DIN rail is designed for accommodating, in a form-fitting and/or force-fitting manner, at least one light emitting module in an accommodating area delimited by the bottom wall and the side walls.

By virtue of the use of the DIN rail, the light-emitting modules no longer need to be screwed, riveted or adhesively bonded individually directly to the body to be illuminated, but the light-emitting modules can simply be inserted into the DIN rail in order to be held thereby. Thus, mounting of the light-emitting modules can be simplified considerably, in particular if a plurality of light-emitting modules are to be inserted into a common DIN rail. In addition, particularly flexible and possibly also easily changeable positioning of the light-emitting modules results, for example by moving or relocating said light-emitting modules within the same DIN rail or to another DIN rail. Thus for example, a luminance and/or a light distribution within the body to be illuminated, in particular the light box, can be adjusted easily.

For particularly flexible mounting, the at least one light-emitting module can be connected detachably to the DIN rail. For particularly secure mounting, for example in the case of frequent mechanical alternating stress on the DIN rail, the at least one light-emitting module can be connected nondetachably to the DIN rail.

The DIN rail can in particular be a longitudinal rail extending linearly in a longitudinal direction.

The DIN rail can in particular be provided for fastening in a light box (light box DIN rail).

One development consists in that the walls form a U-shaped profile or the DIN rail is a U-shaped DIN rail in profile, which enables simple production and use. Alternatively, the profile can be, for example, trapezoidal (with inwardly inclined side walls) etc.

One configuration consists in that the DIN rail for accommodating, in a form-fitting and/or force-fitting manner, the at least one light-emitting module has holding elements or holder elements arranged with a regular longitudinal pattern on at least one wall. As a result, the at least one light-emitting module can be fastened precisely in or on the DIN rail using simple means in defined position steps.

The holder elements can be in particular latching elements. The at least one light-emitting module can have in particular at least one mating latching element for matching one of the latching elements in order to use the latching option.

The regular longitudinal pattern can be or comprise in particular a row with a regular grid spacing ("light source grid spacing", "pitch" or "pitch spacing").

A further configuration consists in that the holder elements, in particular latching elements, are in the form of projections protruding into the accommodating area and/or in the form of recesses (cutouts or notches). The at least one light-emitting module can then have in particular at least one latching recess and/or at least one latching projection. Such holder elements can be implemented particularly easily.

The holder elements can be introduced into the bottom wall and/or into one or both side walls, for example. Thus, projections, in particular latching lugs, can be introduced into both side walls, in particular at the same height. As an alternative or in addition, these holder elements can be latching recesses, for example cutouts in the form of circular holes or longitudinal holes or notches with this form (for example dents). As an alternative or in addition, recesses or projections, in particular lugs, can be introduced into the bottom wall, for example.

A further configuration consists in that cable tie cutouts arranged with a regular longitudinal pattern are introduced into at least one of the two side walls. This provides the advantage that electrical connecting lines can be fixed between two light-emitting modules inserted in the DIN rail with regular spacings, for example by virtue of the fact that a cable tie is passed through a cable tie cutout, which surrounds the connecting lines and ties them to the DIN rail. In addition, a simple possible way of supplying electrical supply lines (for example from a ballast or driver) is thus enabled with a regular spacing. The cable tie cutouts can also be used for passing through a tool (screwdriver, ejecting tool, etc.), for example for ejecting an already accommodated light-emitting module.

In addition, a configuration consists in that screw holes, in particular pairs of screw holes, arranged with a regular longitudinal pattern are introduced into at least one of the two side walls. The screw holes can be used for screwing or else other types of fastening, for example riveting, and therefore represent in particular general fastening holes. By means of these screw holes, the DIN rail can be used not only for fastening light-emitting modules, but also for mounting other DIN rails. The DIN rails can therefore perform a dual function as holder for the light-emitting modules and as mounting rail or mounting support for other DIN rails. This simplifies storage and mounting and enables a less expensive production. The use of pairs of screw holes reduces the risk of waste material in the case of disconnection or assembly in the region of the screw holes.

This use of the DIN rails as mounting rails as well enables a one-sided and two-sided alignment of the DIN rails equipped with the light-emitting modules (and therefore also of the light-emitting modules), in particular for one-sided or two-sided backlighting of a light box. The two-sided alignment (in the case of which at least one DIN rail equipped with light-emitting modules is aligned in one direction and at least one other DIN rail is aligned in the opposite direction) is supported by identically configured side walls (which may be longitudinally offset with respect to one another in terms of their functional elements, such as cable tie cutouts, screw holes etc.).

In addition, a development consists in that fastening cutouts are introduced into the bottom wall, which fastening cutouts are provided for fastening the DIN rail. The fastening cutouts can be in particular screw holes for passing through screw threads. By means of these fastening cutouts or in particular screw holes, the DIN rails, for example with the rear side of the bottom wall (which faces away from the side walls), can be attached, in particular screwed, to a suitable body. The body can be, for example, a wall, in particular a frame, of a light box. However, the body can also be another DIN rail, wherein the screw can be tightened at one of the screw holes in the other DIN rail. The screw holes are longitudinal holes which are preferably aligned in the longitudinal direction of the DIN rail for flexible positioning.

A further configuration consists in that identical groups each having at least one holder element, one cable tie cutout and one screw hole, in particular one pair of screw holes, are introduced into at least one of the two side walls with a regular longitudinal pattern. As a result, the functions made possible by these elements (latching function, cable fixing function, DIN rail mounting function, line feed function etc.) can all be provided with the regular pattern, which simplifies mounting further still.

Yet a further configuration consists in that the groups are introduced into both side walls with an identical regular longitudinal pattern, and the groups of the two sides are offset with respect to one another through half a grid spacing. This enables more refined assembly of the DIN rails (for example by sawing down or the like) without any loss of functionality.

Yet a further configuration consists in that the DIN rail consists of sheet aluminum. This enables effective heat dissipation from the light-emitting module used at comparatively low cost. However, the DIN rail is not restricted to this and can also consist of another metal (copper, steel etc.) or of plastics, for example.

Another configuration consists in that the DIN rail has a sheet thickness of approximately 1 mm. This is because it has been demonstrated that such a sheet thickness represents a particularly good compromise between sufficient elastic flexibility and sufficient mechanical stability.

Another aspect of the invention is directed to a connecting element for connecting at least two DIN rails, in particular arranged in a row, wherein (a) the connecting element has a bottom wall and two side walls emerging from the bottom wall on opposite sides, (b) the walls form a profile, in particular U shaped profile, (c) the connecting element is designed for accommodating at least one DIN rail in an accommodating area delimited by the bottom wall and the side walls, and (d) the connecting element has latching elements arranged with a regular longitudinal pattern on at least one wall for latching with an accommodated DIN rail. This enables a particularly simple combination of DIN rails, to be precise with a flexibly adjustable but in each case well defined spacing. The spacing, in particular grid spacing, is automatically maintained.

A width of the accommodating area of the connecting element (spacing between the opposite inner faces of the side walls) preferably corresponds substantially to a width of the DIN rail (spacing between the outer faces of the side walls) in order for there to be accommodation with a good fit.

One configuration consists in that the latching elements are in the form of latching projections, which are arranged on the side walls, are directed towards the accommodating area for the DIN rail and are designed and arranged for latching at least one of the cable tie cutouts in the DIN rail. The cable tie cutouts can thus additionally act as latching cutouts for latching the connecting element, which simplifies production and improves structural stability.

The latching projections can be tabs introduced by stamping, casting or cutting, for example.

The connecting element can be produced from metal, in particular aluminum, or plastics, for example.

Another aspect of the invention is directed to a light emitting module with at least one semiconductor light source, wherein (a) the light emitting module is intended and designed to be accommodated in the accommodating area of the DIN rail as claimed in claim 3, (b) the at least one semiconductor light source is directed out of an open side of the accommodating area, and (c) the light emitting module has recesses and/or projections to match the projections and/or recesses on or in the DIN rail. Thus, a light emitting module which can be fastened in a particularly simple manner and such that it can be held on the DIN rail can be provided.

The recesses and/or projections to match the projections and/or recesses on and/or in the DIN rail can comprise, for example, lateral longitudinal slots, in particular continuous longitudinal slots, in order to provide a defined press fit with one or more projections on the DIN rail. This press fit does not need to be latching, with the result that the light-emitting module (possibly also after use thereof) can be moved continuously into the DIN rail in the longitudinal direction of the DIN rail. However, the longitudinal slot prevents the light-emitting module from becoming detached from the DIN rail or prevents the DIN rail from bending up or the like. Alternatively, projections and/or recesses enabling a latching connection can also be provided here, for example notches for engagement with latching projections on the DIN rail, which notches are spaced apart, for example, in particular spaced apart with a regular pattern or spacing.

Preferably, the at least one semiconductor light source comprises at least one light-emitting diode. In the event of the provision of a plurality of light-emitting diodes, said light-emitting diodes can illuminate in the same color or in different colors. A color can be monochrome (for example red, green, blue etc.) or multichrome (for example white). It is also possible for the light emitted by the at least one light-emitting diode to be an infrared light (IR LED) or an ultraviolet light (UV LED). A plurality of light-emitting diodes can produce a mixed light, for example a white mixed light. The at least one light-emitting diode can contain at least one wavelength-converting phosphor (conversion LED). The at least one light-emitting diode can be present in the form of at least one individually housed light-emitting diode or in the form of at least one LED chip. A plurality of LED chips can be mounted on a common substrate ("sub-mount"). The at least one light-emitting diode can be equipped with at least one dedicated and/or common optical element for beam guidance, for example with at least one lens with an elliptical light distribution (in particular for lateral irradiation) or a so-called "batwing" distribution (in particular for backlighting), with at least one Fresnel lens, at least one collimator, etc. In place of or in addition to inorganic light-emitting diodes, for example on the basis of InGaN or AlInGaP, in general also organic LEDs (OLEDs, for example polymer OLEDs) can also be used. Alternatively, the at least one semiconductor light source can have at least one diode laser, for example.

Another aspect of the invention is directed to a light-emitting system, having at least one DIN rail as described above and at least one light emitting module which can be inserted into the at least one DIN rail and has at least one semiconductor light source, in particular as described above.

One configuration consists in that (a) the at least one light-emitting module has in each case a plurality of semiconductor light sources which are arranged in a row with a substantially constant light source grid spacing, (b) the cable tie cutouts in the DIN rail are arranged in a row with a substantially constant grid spacing, and (c) the light source grid spacing ("pitch"), for example 110 mm or 165 mm etc., corresponds to a multiple of the grid spacing of the cable tie cutouts and/or the screw holes, for example 55 mm. Thus, a grid spacing between semiconductor light sources can also be maintained by a plurality of light-emitting modules with at the same time flexible positioning.

A further configuration consists in that the light-emitting system has a plurality of DIN rails, wherein at least one, preferably at least two, of the DIN rails is provided as a mounting component for mounting at least one other of the DIN rails at the end. As a result, a dual function of the DIN rails can be achieved, which enables simpler storage and mounting and inexpensive production.

Another aspect of the invention is directed to a light box with at least one DIN rail as described above or with a light emitting system as described above.

DETAILED DESCRIPTION OF THE DRAWINGS

Figure 1:
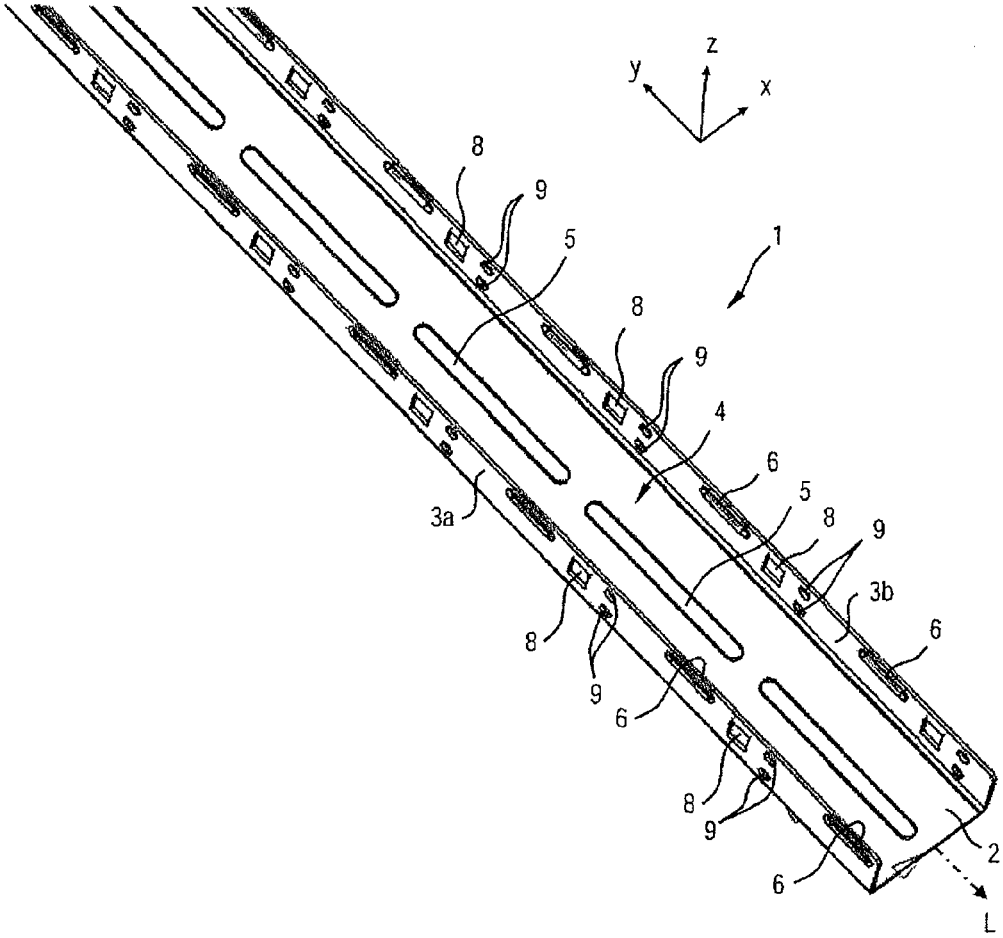
FIG. 1 shows an angled view of a detail of a possible DIN rail according to an embodiment of the invention.
Figure 2:
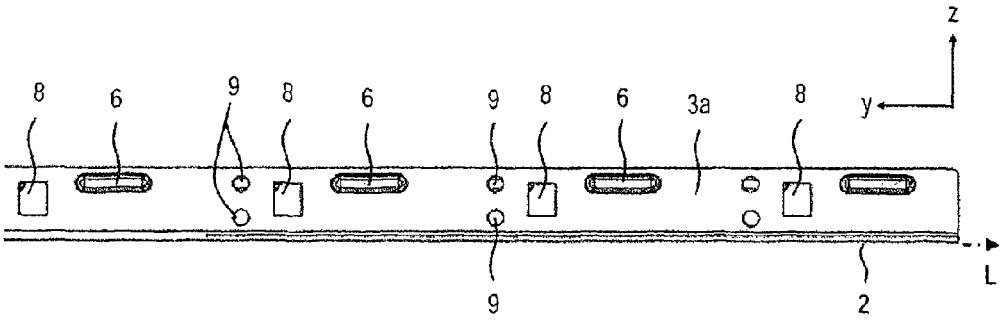
FIG. 2 shows a side view of a detail of the DIN rail according to an embodiment of the invention.
Figure 3:
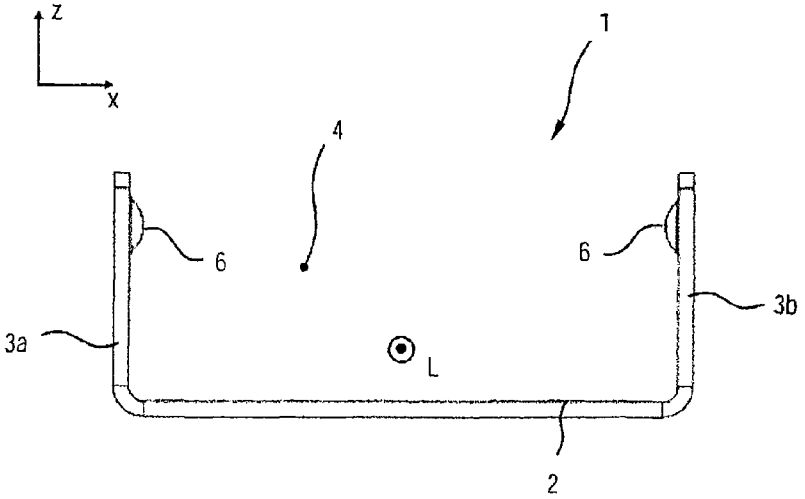
FIG. 3 shows a front view of the DIN rail according to an embodiment of the invention.

FIG. 1 shows an angled view of a detail of a DIN rail 1 in the region of a longitudinal end. The DIN rail 1 is a linear rail with a longitudinal extent along a longitudinal axis L. FIG. 2 shows the DIN rail 1 in a side view in the x direction. FIG. 3 shows a front view in the y direction of the DIN rail 1.

The DIN rail 1 has a U-shaped profile (in section perpendicular to the longitudinal axis L), in which two side walls 3*a*, 3*b* integrally adjoining opposite sides emerge from a bottom or a bottom wall 2, to be precise substantially at right angles upwards (in the z direction). The DIN rail 1 is produced from sheet aluminum with a sheet thickness of approximately 1 mm, for example by stamping and bending. The bottom wall 2 and the side walls 3*a*, 3*b* delimit an accommodating area 4.

The bottom wall 2 has a plurality of longitudinal holes 5 extending in the direction of the longitudinal axis L in the center. The longitudinal holes 5 are arranged in a straight row and have equal spacing and grid spacing from one another. The longitudinal holes 5 act as fastening cutouts for fastening the DIN rail 1, for example in a light box. The DIN rail 1 can be screwed on by means of the longitudinal slots 5, for example, wherein the longitudinal slots, for more precise positioning, enable a limited longitudinal displaceability of the DIN rail 1 when the screw(s) is/are not yet tightened.

Both side walls 3*a*, 3*b* each have a plurality of elongate holder projections 6 which extend in the direction of the longitudinal axis L and extend in the direction of the respective other side wall 3*a*, 3*b* and therefore into the accommodating area 4. The holder projections 6 have an equal grid spacing. The holder projections 6 have an elongated form. The holder projections can be produced by deformation from sheet aluminum, for example, by means of sheet bending, for example.

A light-emitting module 7 inserted into the accommodating area 4 can be held by means of the holder projections 6, for example continuously longitudinally displaceably or latched in the longitudinal direction. The holder projections 6 can also provide a form-fitting connection perpendicular to the longitudinal axis L in order to hold the light-emitting module 7 in the accommodating area 4.

Both side walls 3*a*, 3*b* additionally each have a plurality of rectangular cutouts, which extend in the direction of the longitudinal axis L and are referred to below as cable tie cutouts 8. Cable ties for fastening cables etc. on the DIN rail can be pulled through the cable tie cutouts 8 or at least one electrical line, for example a power supply line, can be pulled through said cutouts to at least one light-emitting module 7 (see FIG. 6, for example). It is also possible for the cable tie cutouts 8 to be used as latching cutouts, for example for a light-emitting module and/or a connecting element in the form of a connecting piece 10 (see, for example, FIG. 4 and FIG. 5). The cable tie cutouts 8 can also be used for passing through a tool (screwdriver, ejection tool etc.), for example for ejecting an already accommodated light-emitting module 7.

Both side walls 3*a*, 3*b* additionally each have a plurality of pairs of screw holes 9 extending perpendicular to the longitudinal axis L (vertically on the side walls 3*a* and 3*b*). A further DIN rail 1 can be fastened on this DIN rail 1 by means of at least one of the screw holes 9, for example by screwing through a longitudinal hole 5 in the further DIN rail 1 and a screw hole 9 in this DIN rail 1. This DIN rail 1 can thus act as a mounting base or mounting rail for the further DIN rail 1.

The functional elements of the side walls 3*a*, 3*b*, namely the holder projections 6, the cable tie cutouts 8 and the screw holes 9, have the same grid spacing and can therefore also be considered to be a group comprising a holder projection 6, a cable tie cutout 8 and a pair of screw holes 9 which is arranged with this grid spacing. The functional elements 6, 8, 9 are arranged identically relative to one another on both side walls 3*a*, 3*b*, but offset through half a grid spacing along the longitudinal axis L with respect to the respective other side wall 3*a* or 3*b*.

Figure 4:
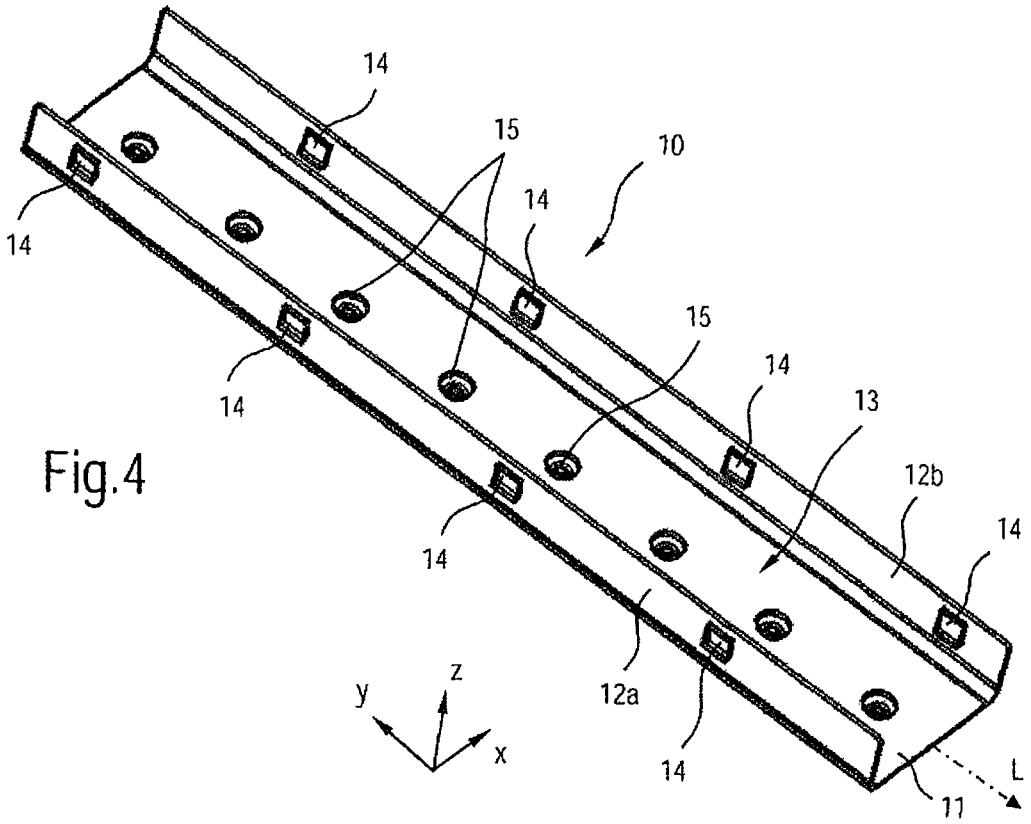
FIG. 4 shows an angled view of a connecting piece for connecting two DIN rails.
Figure 5:
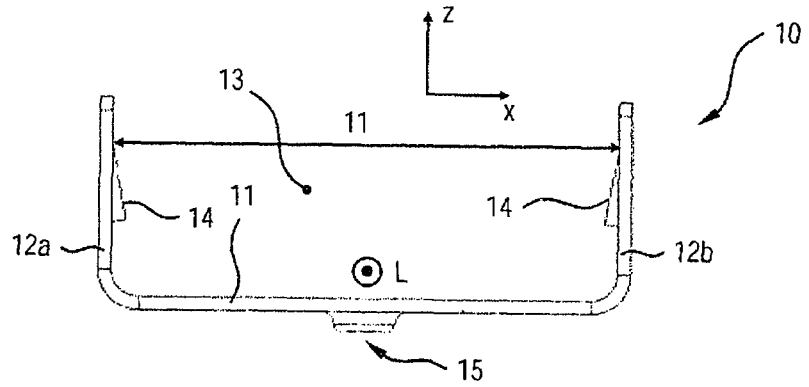
FIG. 5 shows the connecting piece in a front view.

FIG. 4 shows an angled view of the connecting piece 10 for connecting two DIN rails, for example the DIN rails 1. FIG. 5 shows the connecting piece 10 in a front view along the y axis.

The connecting piece 10 is likewise configured as a U-shaped DIN rail and has a bottom wall 11 and two side walls 12*a*, 12*b* emerging from the bottom wall 11 on opposite sides. The connecting piece 10 is used for accommodating at least one DIN rail (not depicted) in an accommodating area 13 delimited by the bottom wall 11 and the side walls 12*a*, 12*b*. For this purpose, the connecting piece 10 has latching elements 14 arranged with a regular longitudinal pattern on both side walls 12*a*, 12*b* for latching with a DIN rail accommodated therein. The latching elements 14 are in this case in the form of tabs protruding into the accommodating area 13. For this purpose, the latching elements 14 have the same arrangement pattern as the cable tie cutouts 8 in the DIN rail 1, with the result that the latching elements 14 can be brought into engagement with the cable tie cutouts 8, which then also act as latching cutouts.

The spacing d1 between the inner sides of the side walls 12*a*, 12*b* approximately corresponds to a total width of the DIN rails 1.

In addition, fastening holes 15 arranged in a regular row for fastening, in particular by means of screws, a DIN rail 1 on the connecting piece 10 are provided in the bottom wall 11, for example by means of a screw which is passed through a longitudinal hole 5 in the DIN rail 1 and is screwed with the fastening hole 15.

Figure 6:
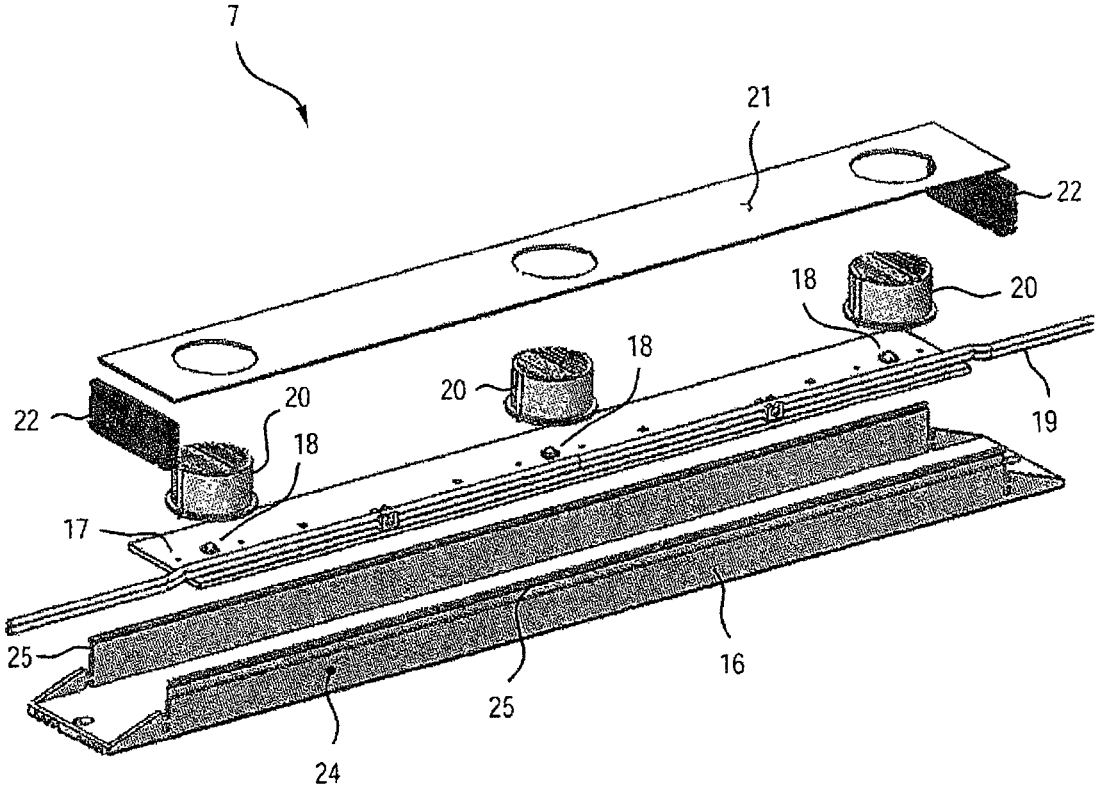
FIG. 6 shows an angled view of an exploded illustration of a light-emitting module according to an embodiment of the invention.

FIG. 6 shows an angled view of an exploded illustration of a light-emitting module 7 according to the invention. The light-emitting module 7 is elongate and can be inserted into the DIN rail 1. For this purpose, the light-emitting module 7 has a housing 16, in which a printed circuit board 17 is accommodated. Three light-emitting diodes 18 with a fixed light source grid spacing ("pitch" or "pitch spacing") are fitted on the printed circuit board 17 and can be supplied with power by means of a continuous electrical cable 19. In each case one optical element 20 for suitably configuring, in particular homogenizing, a light bundle emitted by the light-emitting diodes 18 is connected downstream of the light-emitting diodes 18. The optical element 20 can therefore have in particular a collimation function. The housing 16 can be covered by means of a cover 21 and by means of side walls 22. The light source grid spacing (for example 110 mm or 165 mm) corresponds to a multiple of the grid spacing of the cable tie cutouts (for example 55 mm).

In order to fasten the light-emitting module 7 in a DIN rail 1, the housing 16 has linear longitudinal slots 25 extending continuously along a longitudinal extent of the light-emitting module 7 on the side walls 24 of said housing 16. The longitudinal slots 25 serve to engage with the holder projections 6, make it possible for the light-emitting module 7 to be moved along a longitudinal axis L (in both directions) and prevent the light-emitting module 7 from becoming detached from the DIN rail 1 in the z direction.

Alternatively, rows of latching recesses, for example latching notches, which are aligned in the longitudinal direction, for latching with the holder projections 6 can be provided for latching instead of the longitudinal slots.

Figure 7:
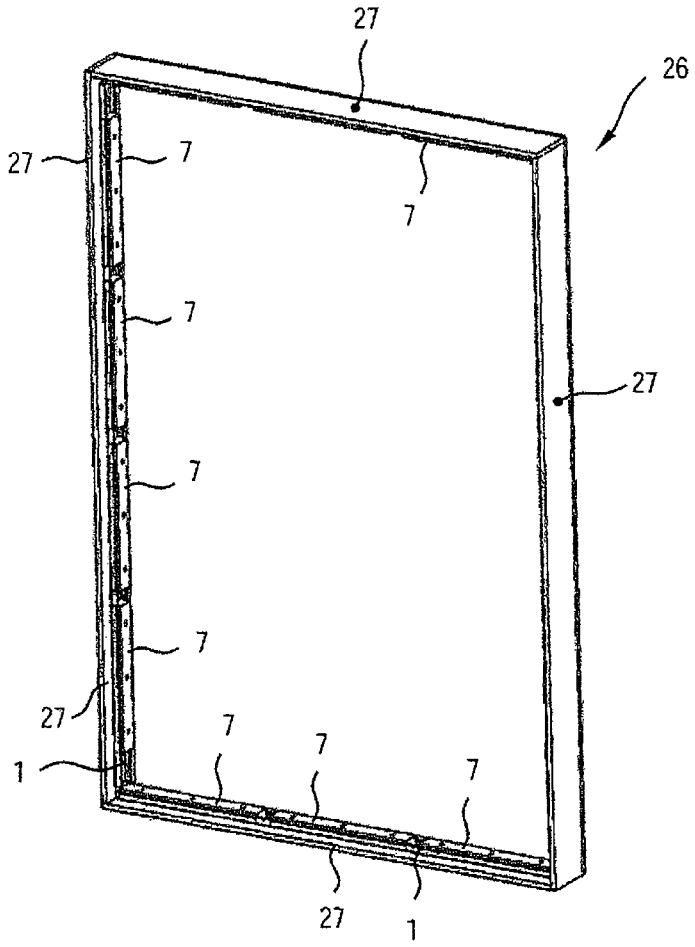
FIG. 7 shows an angled view of a light box open at the front with the DIN rails according to an embodiment of the invention with lateral fastening on four sides.
Figure 8:
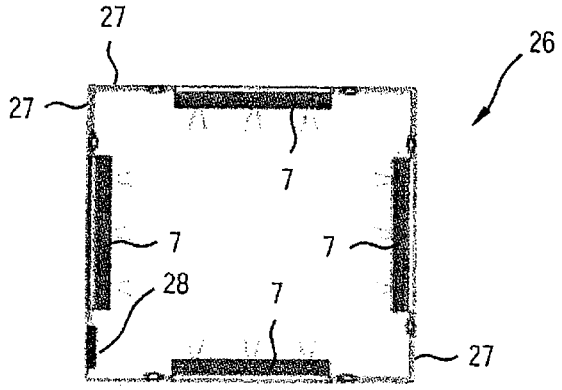
FIG. 8 shows a front view of a sketch of the light box with the DIN rails with lateral fastening on four sides.

FIG. 7 shows an angled view of a light box 26 open at the front with DIN rails 1 and light-emitting modules 7 fastened on the side walls or frames 27 of said light box, to be precise with lateral fastening on four sides (at the top, at the bottom, on the left and on the right). FIG. 8 shows a front view of a sketch of the light box 26. As shown in FIG. 8, the light-emitting modules 7 radiate (in this case elliptically) laterally into the space in the light box 26.

For this purpose, in each case one DIN rail 1 is fastened on each frame 27, for example by means of screwing through the longitudinal holes 5. While in each case four light-emitting modules 1 are latched (in particular snapped) into the DIN rails 1 of the lateral frames 27, in each case three light-emitting modules 7 are inserted into the lower frame 27 and the upper frame 27. Typically, a ballast 28 is also provided in the light source 26 (see FIG. 8) in order to supply an electrical signal (current, voltage etc.) to the light-emitting modules 7. For this purpose, the ballast can be electrically connected to the light-emitting modules 7 via an appropriate power line.

Figure 9:
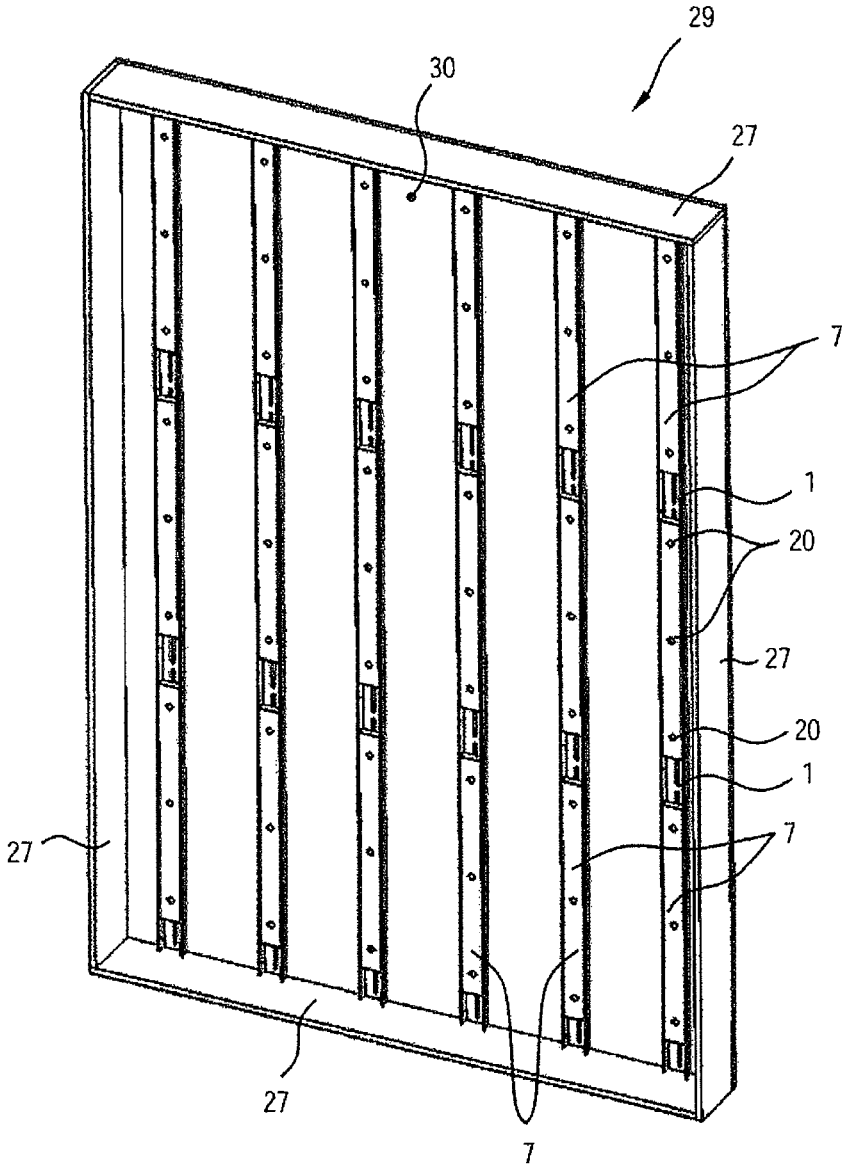
FIG. 9 shows an angled view of a light box open at the front with the DIN rails according to an embodiment of the invention with fastening for one-sided backlighting.

FIG. 9 shows an angled view of a light box 29 open at the front with DIN rails 1 with fastening for one-sided backlighting. In this light box 29, six DIN rails 1 are mounted, in particular screwed, perpendicularly on a rear side 30 of the light box 29 in order to backlight the front side. Three light-emitting modules, for example light-emitting modules 7, are inserted into each of the DIN rails 1.

Figure 10:
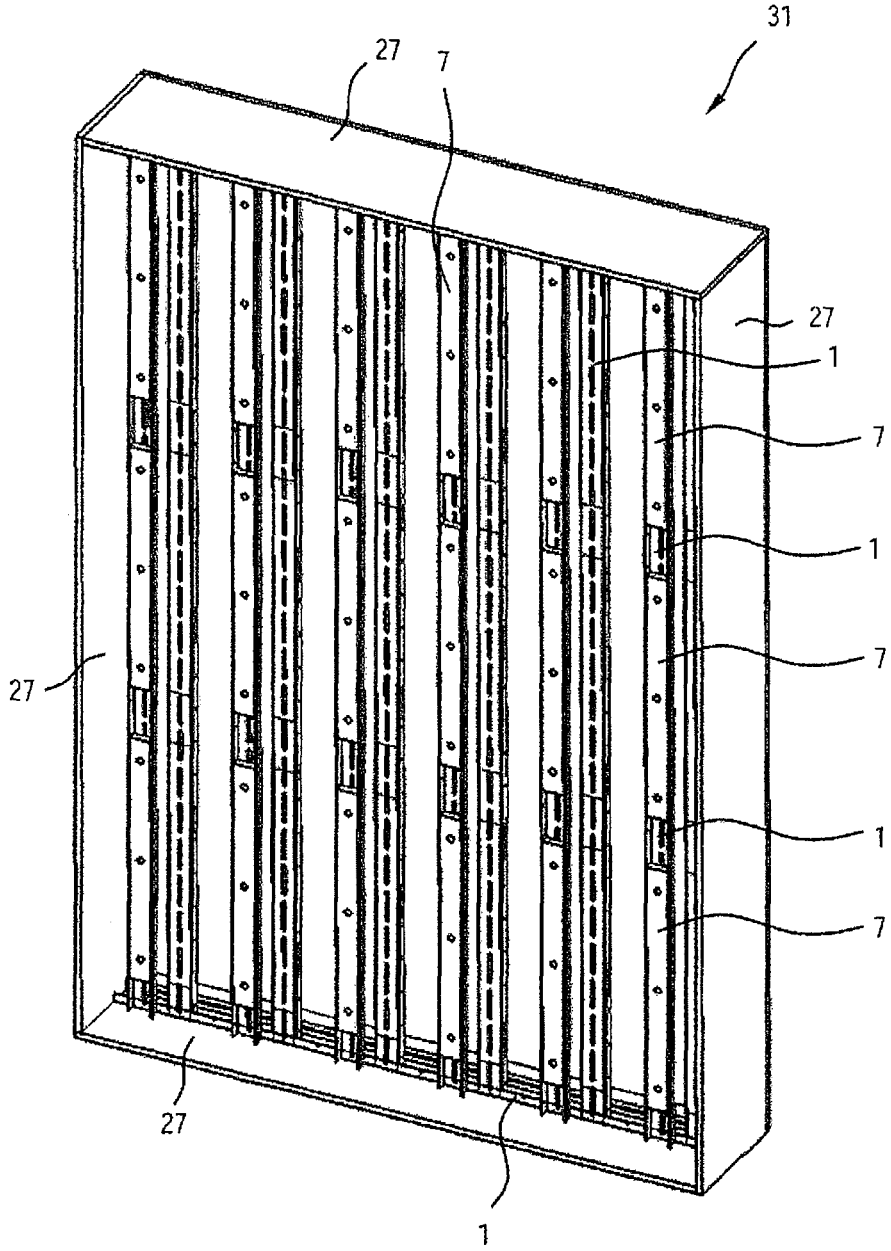
FIG. 10 shows an angled view of a light box open at the front with the DIN rails according to an embodiment of the invention with fastening for two-sided backlighting.

FIG. 10 shows an angled view of a light box 31 open at the front with the DIN rails 1 with fastening for two-sided backlighting. Twelve DIN rails 1 each having three light-emitting modules 7 are now accommodated perpendicularly or vertically in the light box 31 for the two-sided backlighting, of which six DIN rails 1 point towards the front side of the light box 31 and six DIN rails 1 point in the opposite direction towards the rear side of the light box 31. Thus, both the front side and the rear side of the light box 31 can be backlit.

In order to position the twelve DIN rails 1 bearing the light-emitting modules 7, in each case one further DIN rail 1 can be mounted on the lower frame 27 and on the upper frame 27 over the length of said DIN rail, for example can be screwed thereto. These further DIN rails 1 are used for fastening a respective end of the perpendicular DIN rails 1 bearing the light-emitting modules 7. For this purpose, the DIN rails 1 bearing the light-emitting modules 7 are screwed through their longitudinal hole 5 to one of the screw holes 9 in the further DIN rails. A uniform workpiece, namely the DIN rails 1, can thus be used both for mounting other DIN rails 1 and for holding the light-emitting modules 7.

Alternatively, a single-sided backlighting arrangement can have the further DIN rails 1.

It goes without saying that the present invention is not restricted to the exemplary embodiment shown.

Thus, in the case of one-sided backlighting, at least one further DIN rail can be used as mounting rail for fastening at least one DIN rail provided with at least one light-emitting module in order thus to be able to variably adjust a spacing with respect to an area to be illuminated, and consequently a luminous intensity and a homogeneity distribution at this area.

The invention claimed is:

1. A DIN rail comprising:

at least one bottom wall;

two side walls emerging from the bottom wall on opposite sides, the bottom wall and the two side walls delimiting an accommodating area;

holder elements arranged longitudinally along at least one of the two side walls; and cable tie cutouts arranged longitudinally along at least one of the two side walls, each of the cable tie cutouts being longitudinally spaced apart from each of the holder elements, wherein the DIN rail is configured to accommodate, in a form-fitting and/or force-fitting manner, at least one light-emitting module in the accommodating area.

2. The DIN rail as claimed in claim 1, wherein the holder elements are arranged with a regular longitudinal pattern on the at least one side wall.

3. The DIN rail as claimed in claim 2, wherein the holder elements are in the form of projections protruding into the accommodating area and/or in the form of recesses.

4. A light-emitting module with at least one semiconductor light source, wherein the light-emitting module is configured to be accommodated in the accommodating area of the DIN rail as claimed in claim 3, the at least one semiconductor light source is directed out of an open side of the accommodating area, and the light-emitting module has recesses and/or projections to match the projections and/or recesses on or in the DIN rail.

5. The DIN rail as claimed in claim 1, wherein the cable tie cutouts are arranged with a regular longitudinal pattern on the at least one side wall.

6. The DIN rail as claimed in claim 1, further comprising pairs of screw holes arranged with a regular longitudinal pattern on at least one of the two side walls.

7. The DIN rail as claimed in claim 1, wherein the DIN rail consists of sheet aluminum with a sheet thickness of approximately 1 mm.

8. A light-emitting system, having at least one DIN rail as claimed in claim 1 and at least one light-emitting module adapted to be inserted into the at least one DIN rail and having at least one semiconductor light source.

9. The light-emitting system as claimed in claim 8, wherein the at least one light-emitting module has in each case a plurality of semiconductor light sources arranged in a row with a substantially constant light source grid spacing, the cable tie cutouts in the DIN rail are arranged in a row with a substantially constant grid spacing, and the light source grid spacing corresponds to a multiple of the grid spacing of the cable tie cutouts.

10. The light emitting system as claimed in claim 8, having a plurality of DIN rails, wherein at least one of the DIN rails is provided as a mounting component for mounting at least one other of the DIN rails at the end.

11. A light box with at least one light-emitting system as claimed in claim 8.

12. The DIN rail as claimed in claim 1, wherein the DIN rail is U-shaped.

13. The DIN rail as claimed in claim 1, wherein said holder elements are latching elements.

14. The DIN rail as claimed in claim 1, wherein at least one of the two side walls has identical groups, each having, longitudinally disposed with respect to one another, at least one holder element and one cable tie cutout, the identical groups each being disposed with respect to one another in a regular longitudinal pattern.

15. The DIN rail as claimed in claim 14, the DIN rail further comprising pairs of screw holes longitudinally arranged on at least one of the two side walls, wherein each of the identical groups further have one pair of screw holes.

16. The DIN rail as claimed in claim 15, wherein the groups are introduced into both side walls with an identical regular longitudinal pattern, and the groups of the two sides are offset with respect to one another through half a grid spacing.

* * * * *